US007199339B2

(12) United States Patent
Shirakata et al.

(10) Patent No.: US 7,199,339 B2
(45) Date of Patent: Apr. 3, 2007

(54) HEATING APPARATUS

(75) Inventors: Jiro Shirakata, Kashiwa (JP); Shinichiro Wakahara, Tokyo (JP); Koji Takematsu, Toride (JP); Koki Watanabe, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/254,708

(22) Filed: Oct. 21, 2005

(65) Prior Publication Data

US 2006/0086731 A1 Apr. 27, 2006

(30) Foreign Application Priority Data

Oct. 22, 2004 (JP) ..... 2004-308906

(51) Int. Cl.
*H05B 6/14* (2006.01)
*G03G 15/20* (2006.01)

(52) U.S. Cl. ..... 219/619; 399/328

(58) Field of Classification Search ..... 219/619, 219/216; 399/328, 330, 333, 334, 335; 156/60, 156/137; 428/319.1, 315.7, 901, 457, 409, 428/458

See application file for complete search history.

(56) References Cited

U.S. PATENT DOCUMENTS 6,453,144 B1 * 9/2002 Sato ..... 399/328
7,099,616 B2 * 8/2006 Kato et al. ..... 399/328
2006/0086721 A1 4/2006 Wakahara et al. ..... 219/619
2006/0086731 A1 4/2006 Shiraka et al. ..... 219/645
2006/0222386 A1 10/2006 Koshida et al. ..... 399/44

FOREIGN PATENT DOCUMENTS

JP 2004-265670 9/2004

* cited by examiner

*Primary Examiner*—Quang Van
(74) *Attorney, Agent, or Firm*—Fitzpatrick, Cella, Harper & Scinto

(57) ABSTRACT

A heating apparatus for heating a material to be heated by heat generated by induction heat generation member includes a magnetic flux generator, a holder for holding and fixing the magnetic flux generator, and an induction heating member which generates heat by electromagnetic induction heating by an action of magnetic flux generated by the magnetic flux generator. A magnetic flux adjuster adjusts an area in which magnetic flux acts on the magnetic flux generator in a longitudinal direction, of the induction heat generation member, perpendicular to a conveyance direction of a material to be heated. The magnetic flux adjuster includes a magnetic flux adjusting member capable of coming into surface contact with the holder in the longitudinal direction of the induction heat generation member and a moving element for moving the magnetic flux adjusting member by sliding the magnetic flux adjusting member on the surface of the holder.

1 Claim, 14 Drawing Sheets

HEATING APPARATUS

FIELD OF THE INVENTION AND RELATED ART

The present invention relates to a heating apparatus of an electromagnetic induction heating-type suitable as a fixing apparatus for thermally fixing an unfixed toner image which is formed of thermally meltable substance directly on recording medium, by an image forming apparatus such as a printer, a copying machine, etc., employing one of the electrophoto-graphic or electrostatic image forming methods.

In a fixing apparatus which employs an electromagnetic induction heat generation member as a heat generation member (heating member) and heatings a material to be heated by Joule heating based on eddy current generated in the electromagnetic heat generation member by causing magnetic flux (alternating magnetic flux) generated by a magnetic flux (magnetic field) generating means to act on the electromagnetic induction heat generation member, a heating apparatus of an electromagnetic induction heating-type is an apparatus for heating-fixing an unfixed toner image on a surface of a recording material by applying heating to the recording material on which the unfixed toner image is formed and carried.

Japanese Laid-open Patent Application 2004-265670 discloses a fixing apparatus of an electromagnetic induction heating-type. This fixing apparatus comprises: a metal sleeve as an induction heat generation member and an elastic pressure roller, which is kept pressed upon the metal sleeve in parallel to the metal sleeve to be rotated; and a coil assembly as a magnetic flux generating means is nonrotatively disposed in the metal sleeve. A high frequency current is passed through the coil of the coil assembly to generate a high frequency magnetic field, so that the metal sleeve is caused to generate heat by induction heating. The recording material bearing an unfixed toner image is introduced into, and conveyed through, a pressure nip portion between the metal sleeve and the elastic pressure roller, and at the pressure nip portion, the unfixed toner image on the recording material is thermally fixed to the surface of the recording material by the heat from the metal sleeve.

In order to obviate a so-called temperature rise phenomenon at a non-sheet-passing portion, the fixing apparatus is provided with a holder for holding a magnetic flux generating means; a magnetic flux adjusting member (magnetic flux shielding means) disposed, between the holder and a metal sleeve as an induction heat generation member, in a noncontact state; and a means for effecting magnetic flux adjustment with respect to the non-sheet-passing portion of the metal sleeve by rotationally moving the magnetic flux adjusting member along an outer peripheral surface of the holder by means of a drive means such as a motor or the like.

In the above described heating apparatus of the electromagnetic induction heating-type, it can be considered that the magnetic flux adjusting member is constituted so that it is slided and rotationally moved along the outer peripheral surface of the holder in order to provide the holder with a guide function at the time when the magnetic flux adjusting member is interposed between a coil and a heat generation member. In the case of this constitution, the magnetic flux adjusting member is repetitively slided and rotationally moved along the outer peripheral surface of the holder, so that contamination, flaw, and the like are caused to occur to some degree at a sliding portion (inner surface of the magnetic flux adjusting member and outer surface of the holder) between the magnetic flux adjusting member and the holder. Such contamination and flaw occur in a streak-like shape in the rotational movement direction of the magnetic flux adjusting member and the sliding portion of the holder, so that there arises no problem of an occurrence of sliding failure or the like during an ordinary rotational movement operation.

As an ordinary material for the magnetic flux adjusting member, a metal or nonmetal material, which is nonmagnetic and has a good electrical conductivity, is used. On the other hand, as a material for the holder, a resin material, which is nonmagnetic and electrically insulative and has a high heat resistance, is used. Further, the sliding portion between the magnetic flux adjusting member and the holder has a long span (length) in a longitudinal direction perpendicular to a recording material conveyance direction on a surface of a recording material conveyance path. As described above, the holder and the magnetic flux adjusting member are formed of different materials and the sliding portion has the long span, so that a length relationship between the magnetic flux adjusting member and the holder varies depending on a difference in thermal expansion (coefficient) between the holder and the magnetic flux adjusting member. As a result, at the sliding portion between the holder and the magnetic flux adjusting member, the above described contamination and flaw are changed in position relative to the respective members depending on a position thereof, so that there arises such a problem that the rotational movement operation of the magnetic flux adjusting member is slow. This slow operation has adversely affected rotation phase control of the magnetic flux adjusting member, temperature detection of the metal sleeve, etc., in some cases.

SUMMARY OF THE INVENTION

An object of the present invention is to provide an electromagnetic induction heating-type heating apparatus capable of performing a smooth sliding operation between a magnetic flux adjusting member and a holder for securely holding a magnetic flux generating means.

According to an aspect of the present invention, there is provided a heating apparatus for heating a material to be heated by heat generated by induction heat generation member, comprising:

magnet flux generating means;

a holder for holding and fixing the magnetic flux generating means;

an induction heating member which generates heat by electromagnetic induction heating by an action of magnetic flux generated by the magnetic flux generating means; and magnetic flux adjusting means for adjusting an area in which magnetic flux acts on the magnetic flux generating means in a longitudinal direction, of the induction heat generation member, perpendicular to a conveyance direction of a material to be heated; the magnetic flux adjusting means comprising a magnetic flux adjusting member capable of coming into surface contact with the holder in the longitudinal direction of the induction heat generation member and moving means for moving the magnetic flux adjusting member by sliding the magnetic flux adjusting member on the surface of the holder;

wherein the following relationship is satisfied:

$$-0.8 \leqq (\alpha-\beta)\times T\times L \leqq 0.7,$$

wherein $\alpha$ represents a coefficient of linear expansion of the magnetic flux adjusting member; $\beta$ represents a coefficient of linear expansion of the holder; T represents an increased temperature (° C.) of the holder from room temperature to a temperature during continuous use of the heating apparatus; and L represents a length (mm) of a sliding portion between the magnetic flux adjusting member and the holder in the longitudinal direction.

By the above constitution, it is possible to realize a heating apparatus capable of maintaining a smooth sliding operation even when a contamination or a flaw is caused to occur at the sliding surface between the holder and the magnetic flux adjusting member during long-term use or the like.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the present invention will be described in detail with reference to the drawings.

(Embodiment 1)

(1) Example of Image Forming Apparatus

Figure 1:
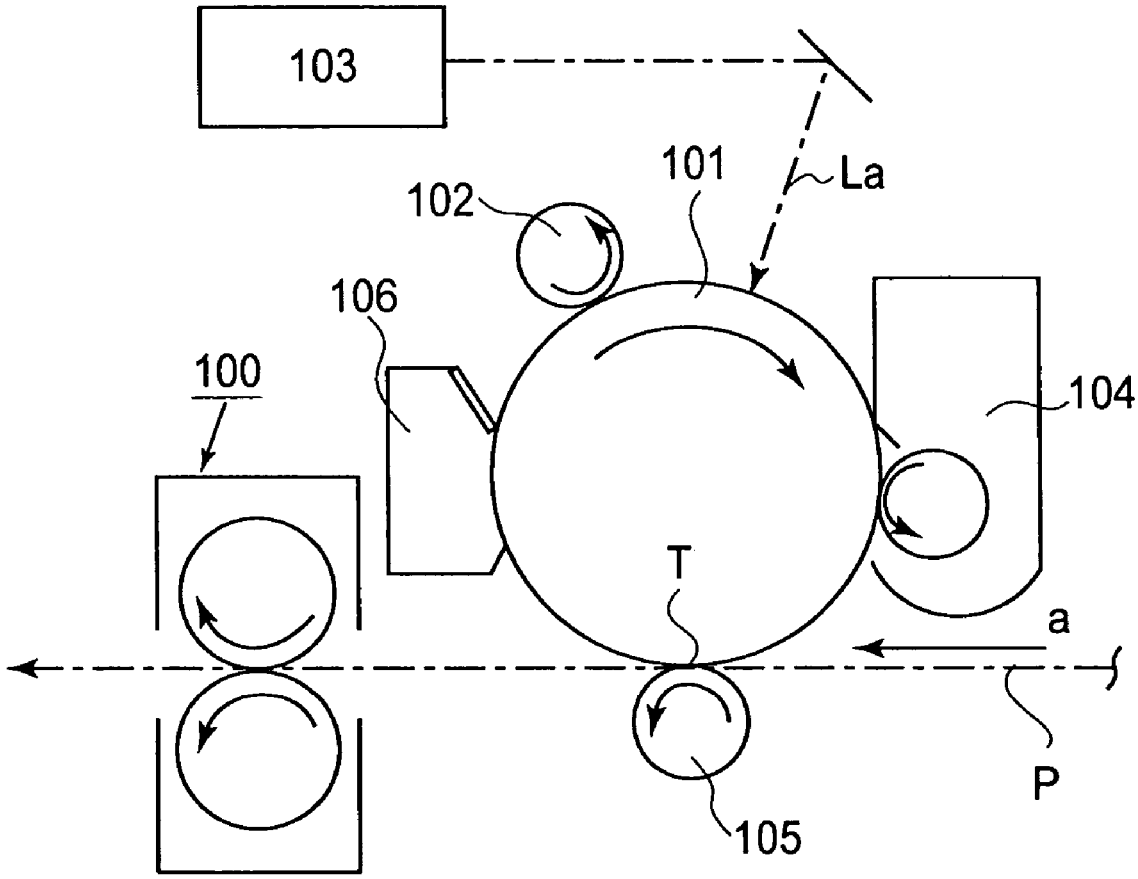
FIG. 1 is a schematic sectional view of an embodiment of an image forming apparatus.

FIG. 1 is a schematic view showing an example of an image forming apparatus employing a heating apparatus, as a thermal image fixing apparatus (hereinafter referred to as a "fixing apparatus"), in accordance with the present invention, which uses the heating method based on electromagnetic induction, showing the general structure thereof. This example of image forming apparatus 100 is a laser printer, which uses a transfer-type electrophotographic process.

Designated by referential numeral 101 is an electrophotographic photosensitive member (hereinafter referred to as "a photosensitive drum") as an image bearing member, which is rotationally driven in the clockwise direction indicated by an arrow, at a predetermined peripheral speed.

Designated by a referential numeral 102 is a charge roller, as a charging means, of the contact type, which uniformly charges electrically the peripheral surface of the photosensitive drum 101 to predetermined polarity and potential level as the photosensitive drum 101 is rotated.

Designated by a referential numeral 103 is a laser scanner as an exposing means, which scans the uniformly charged peripheral surface of the photosensitive drum 101 by emitting a beam of laser light La while modulating it with time-sequential digital electrical signals corresponding to image information, as the photosensitive drum 101 is rotationally driven. As a result, an electrostatic latent image is formed in a pattern corresponding to a scanning exposure pattern on the peripheral surface of the photosensitive drum 101.

Designated by a referential numeral 104 is a developing apparatus, which normally or reversely develops the electrostatic latent image on the peripheral surface of the photosensitive drum 101, into a toner image.

Designated by a referential numeral 105 is a transfer roller as a transferring means, which is pressed against the peripheral surface of the photosensitive drum 101 at a predetermined pressing force to form a transfer nip (portion) T, to which a recording material P as a material to be heated is conveyed from an unshown sheet feeding/conveying mechanism at a predetermined control timing, and then, is conveyed through the transfer nip T while being pinched by the photosensitive drum 101 and transfer roller 105. A predetermined transfer bias is applied to the transfer roller 105 at a predetermined control timing. As a result, the toner image on the peripheral surface of the photosensitive drum 101 is electrostatically transferred successively onto the surface of the recording material P.

After being conveyed out of the transfer nip T, the recording material P is separated from the peripheral surface of the photosensitive drum 101, and introduced into the fixing apparatus 100, which fixes the unfixed toner image on the recording material P by applying heat and pressure to the introduced recording material and the unfixed toner image thereon; it turns the unfixed image into a permanent image. After the fixation, the recording material P is conveyed out of the fixing apparatus.

Designated by a referential numeral 106 is a device for cleaning the photosensitive drum 101, which removes the transfer residual toner remaining on the peripheral surface of the photosensitive drum 101 after the separation of the recording material P from the peripheral surface of the photosensitive drum 101. After the cleaning of the peripheral surface of the photosensitive drum 101, the peripheral surface of the photosensitive drum 101 is repeatedly subjected to subsequent image formation.

The direction indicated by a referential symbol a is the direction in which the recording material P is conveyed. As for the positioning of the recording material P relative to the main assembly of the image forming apparatus, in terms of the direction perpendicular to the recording material conveyance direction a, the recording medium P is conveyed through the main assembly so that the center line of the recording material P is kept aligned with the center of the fixing roller (center line-based sheet passing standard).

(2) Fixing Apparatus 100

Figure 2:
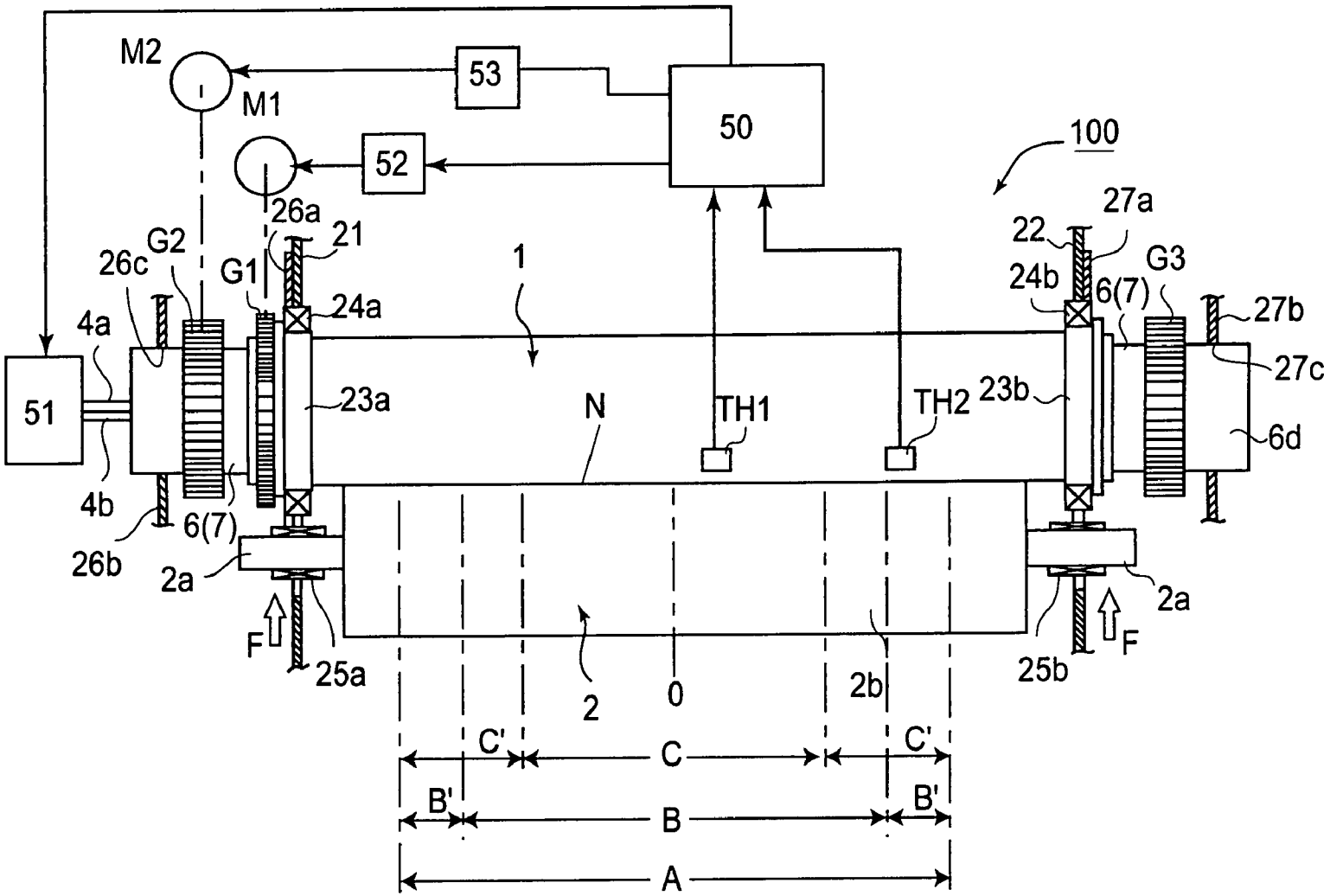
FIG. 2 is a schematic front view of a principal portion of a fixing apparatus.
Figure 3:
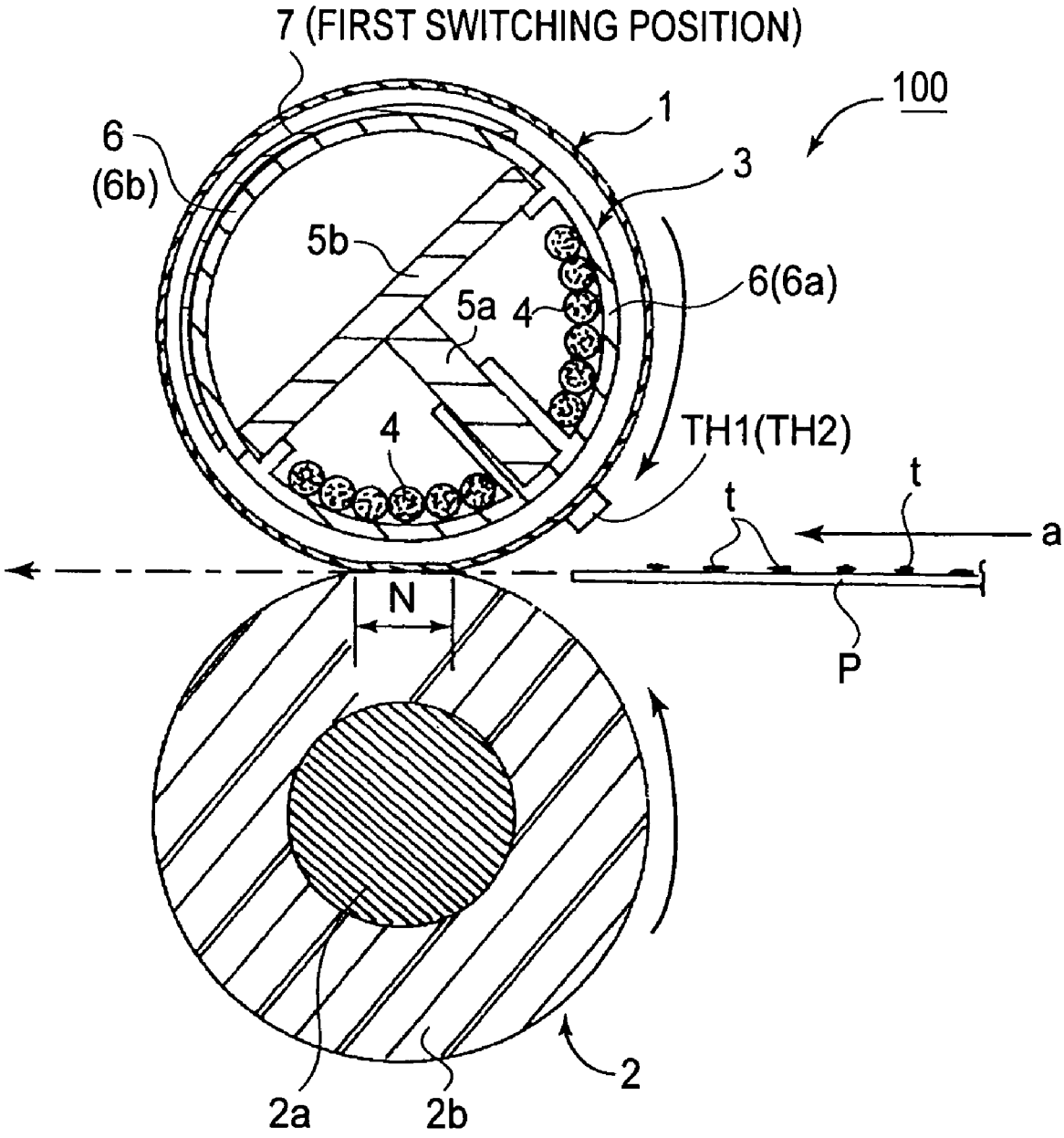
FIG. 3 is a schematic enlarged cross-sectional view of the principal portion of the fixing apparatus.
Figure 4:
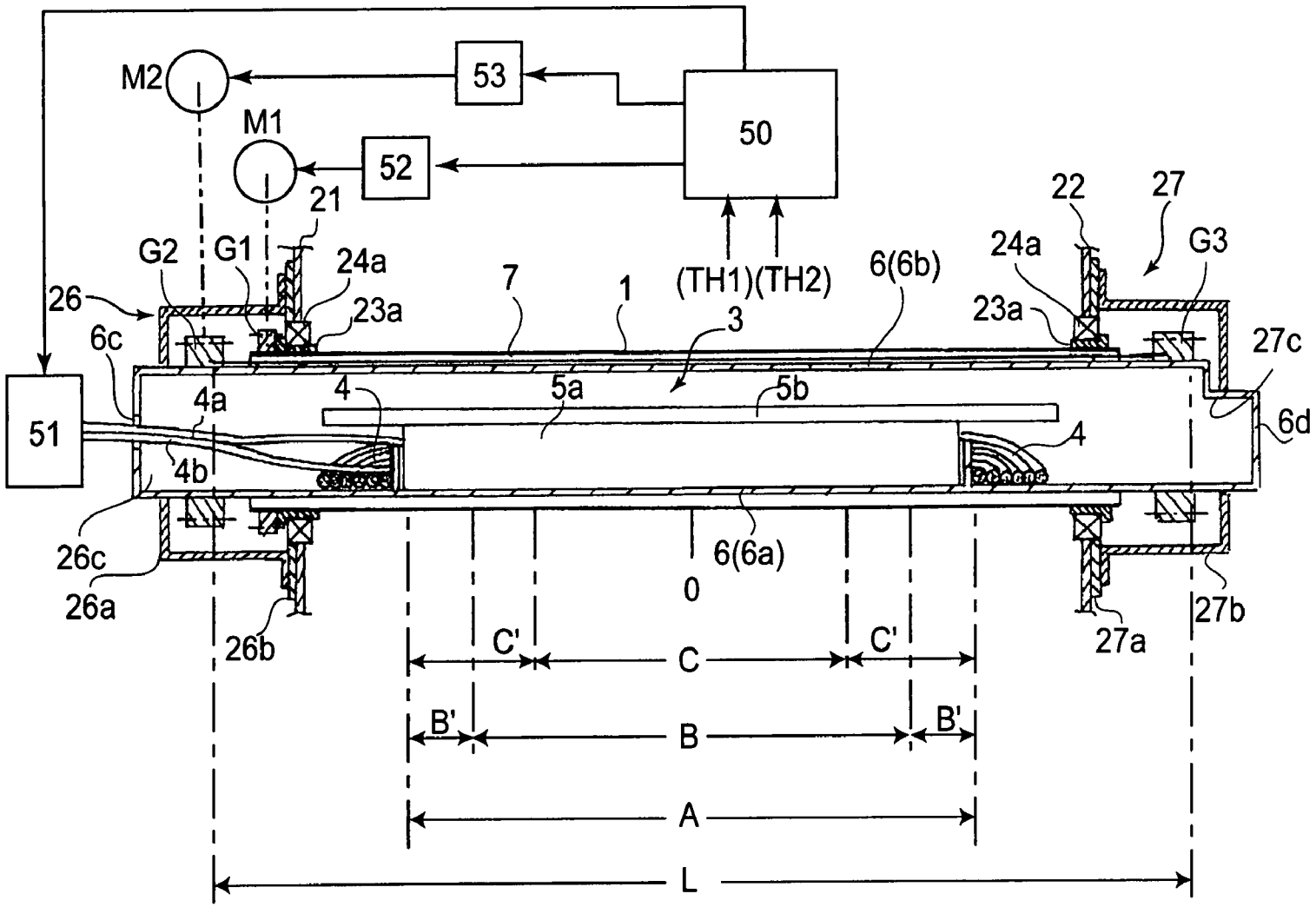
FIG. 4 is a schematic longitudinal sectional view of a fixing roller assembly portion.

FIG. 2 is a schematic front view of a principal portion of the fixing apparatus, and FIG. 3 is an enlarged schematic cross-sectional view of the principal portion of the fixing apparatus. FIG. 4 is a schematic longitudinal sectional view of the fixing roller assembly portion of the fixing apparatus.

Designated by a referential numeral 1 is a fixing (fixation) roller as an induction heat generation member. The fixation roller 1 is formed of such a material as iron, nickel, and SUS 430 (electrically conductive magnetic material), in which heat can be generated by electromagnetic induction. It is a cylindrical, and the thickness of its wall is in the range of 0.1 mm–1.5 mm. Generally, it comprises a release layer as the surface layer, or the combination of a release layer, an elastic layer, etc. Using one of the ferromagnetic metals (metallic substances with high level of permeability), as the material for the fixation roller, makes it possible to confine a larger portion of the magnetic flux generated from the magnetic flux generating means, in the wall of the fixation roller 1. In other words, it makes it possible to increase the fixation roller in magnetic flux density, making it thereby possible to more efficiently induce eddy current in the surface portion of the metallic fixation roller.

This fixing apparatus 100 is provided with a front plate 21, a rear plate 22, a front fixation roller supporting member 26 (fixation roller positioning plate), a rear fixation roller supporting member 27 (fixation roller positioning plate). To the fixation roller supporting members 26 and 27, first supporting portions 26*a* and 27*a* are attached, respectively. The fixation roller 1 is provided with a pair of heat insulating bushings 23*a* and 23*b*, which are fitted around the lengthwise end portions of the fixation roller 1. It is rotatably supported at the front and rear lengthwise end portions by the portions 26*a* and 27*a* of the front and rear supporting members 26 and 27, with the interposition of bearings 24*a* and 24*b* disposed between the bushing 23*a* and the portion 26*a* of the front supporting member 26, and between the bushing 23*b* and portion 27*a* of the rear supporting member 27, respectively.

Figure 5:
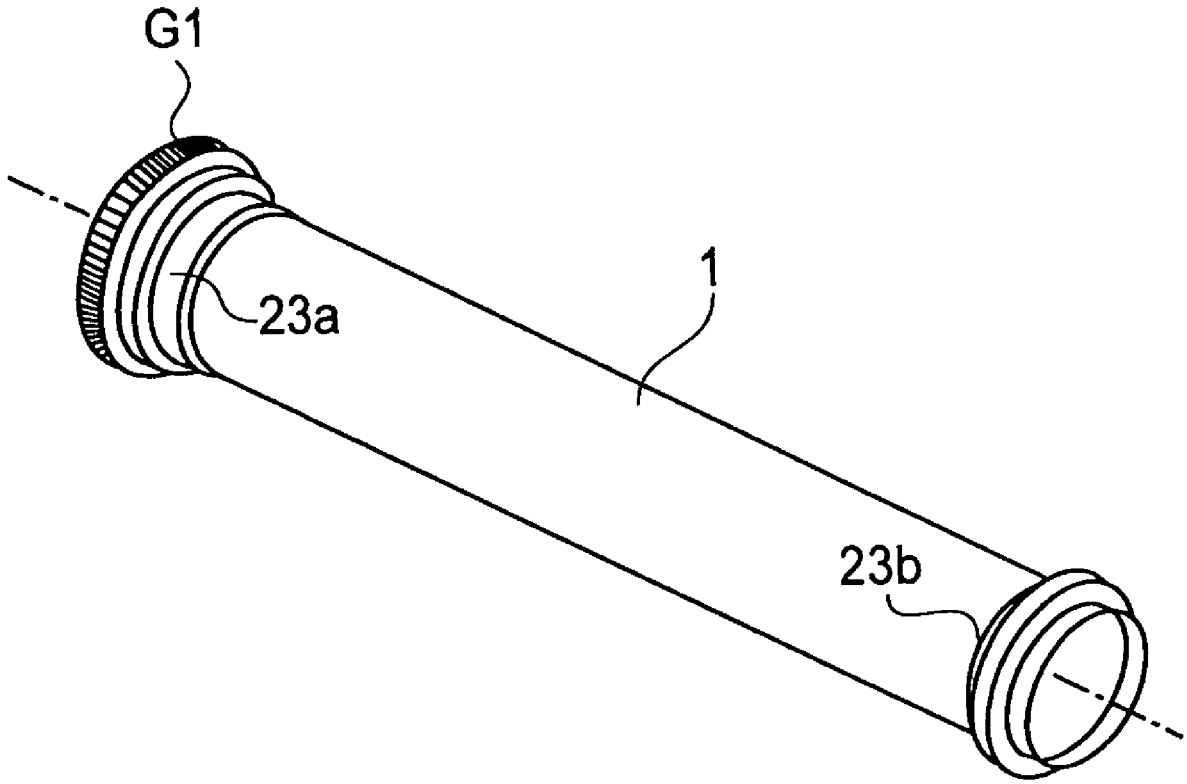
FIG. 5 is an external perspective view of a fixing roller in a state that a heat-resistant bushing and a fixing roller gear are attached to the fixing roller.

The heat insulating bushings 23*a* and 23*b* are employed to minimize the heat transmission from the fixation roller 1 to the bearings 24*a* and 24*b*. Designated by a referential symbol G1 is a fixation roller driving gear fitted fast around the front end portion of the fixation roller 1. As the rotational force from a first motor M1 is transmitted to this gear G1 through a driving force transmission system (unshown), the fixation roller 1 is rotationally driven at a predetermined peripheral speed in the clockwise direction indicated by an arrow in FIG. 3. FIG. 5 is an external perspective view of the fixation roller 1 fitted with the pair of heat insulating bushings 23*a* and 23*b* and the fixation roller gear G1.

Designated by a referential numeral 2 is a pressure roller as a pressure (applying) member, which is an elastic roller made up of a metallic core 2*a*, a cylindrical elastic layer 2*b* fitted integrally and concentrically around the metallic core 2*a*, etc. The elastic layer 2*b* is a layer formed of a rubbery substance, for example, silicone rubber, which has the releasing property and is heat resistant. This pressure roller 2 is disposed under the fixation roller, in parallel to the fixation roller, being rotatably supported by the front and rear end portions of the metallic core 2*a*, with a pair of bearings 25*a* and 25*b*attached to the front and rear plates 21 and 22, respectively, in such a manner that they can be slide toward the fixation roller 1. Further, the bearings 25*a* and 25*b* are kept pressured upward toward the fixation roller 1 by a pair of urging means (unshown). With the provision of the above described structural arrangement, the pressure roller 2 is pressed against the downwardly facing portion of the peripheral surface of the fixation roller 1, so that a predetermined pressing force F is applied between the fixation roller 1 and pressure roller 2 against the elasticity of the elastic layer 2*b*. As a result, a fixation nip N, as a heating nip, with a predetermined width is formed between the fixation roller 1 and pressure roller 2. As the fixation roller 1 is rotationally driven, the pressure roller 2 is rotated by the friction which occurs between the fixation roller 1 and pressure roller 2 in the fixation nip N.

Figure 6:
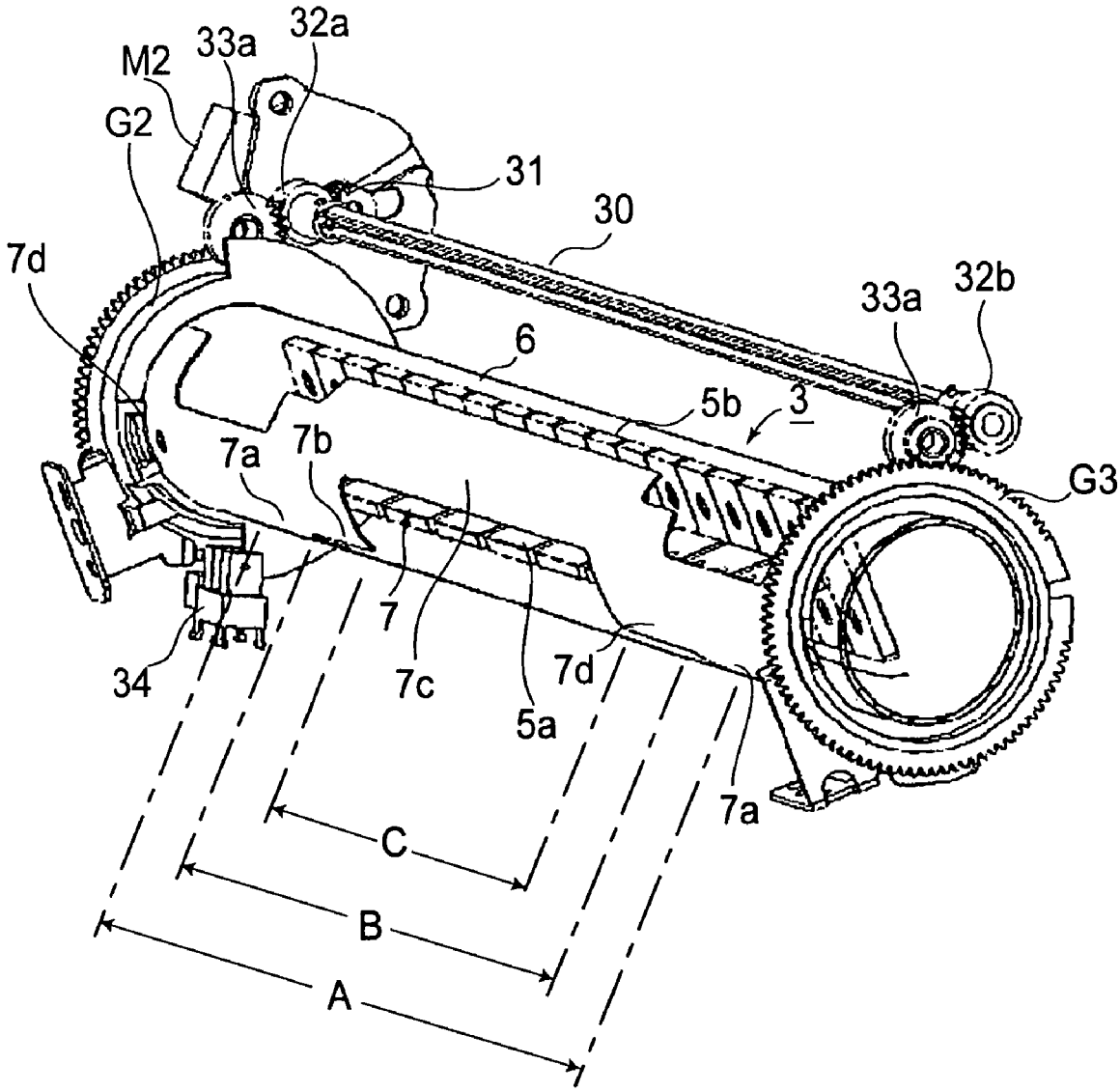
FIG. 6 is an external perspective view of an exciting coil assembly and a moving means for moving a magnetic flux adjusting member.
Figure 7:
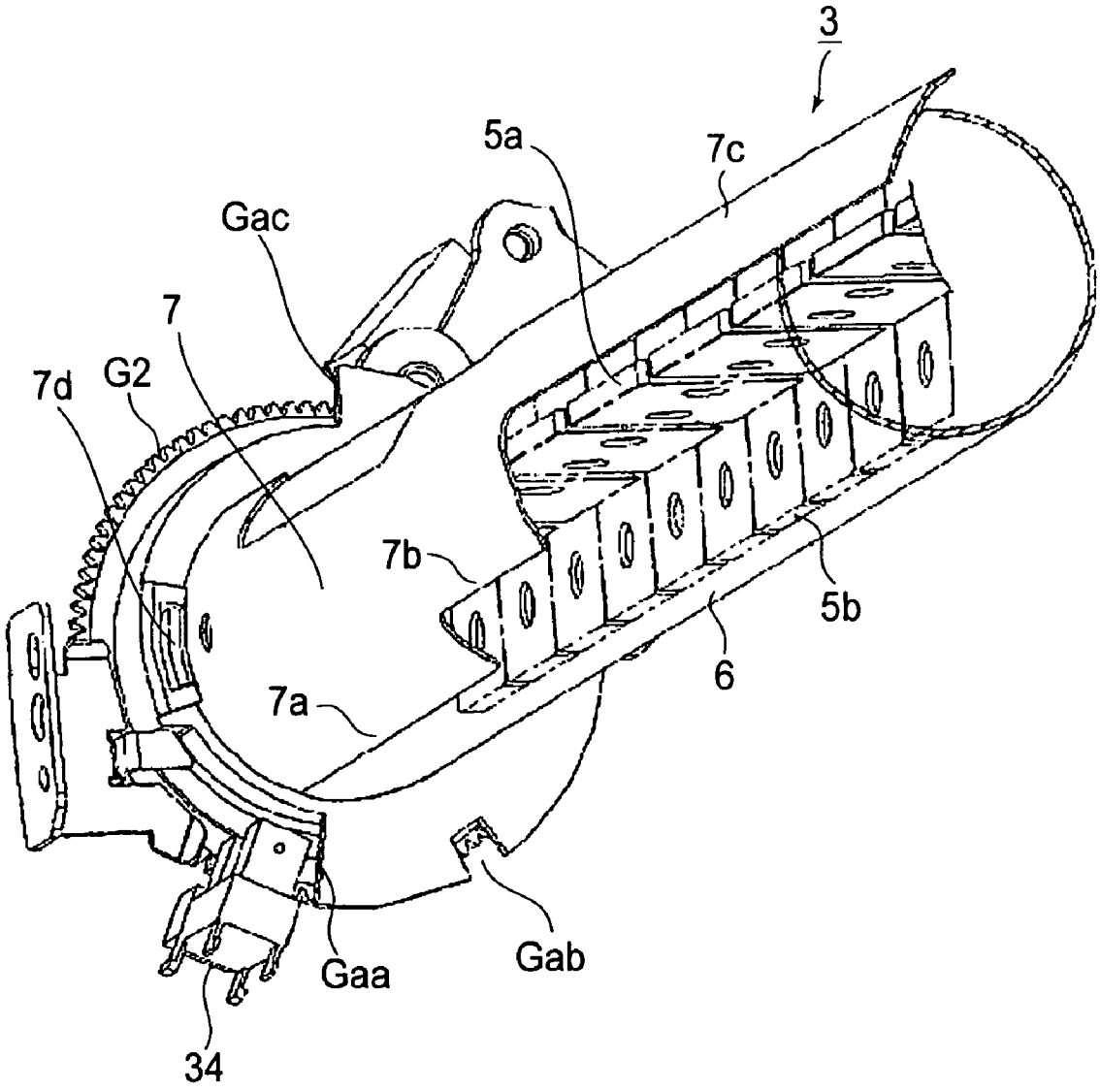
FIG. 7 is an enlarged external perspective view of the exciting coil assembly and a first shutter gear attached thereto at one end portion thereof.
Figure 8:
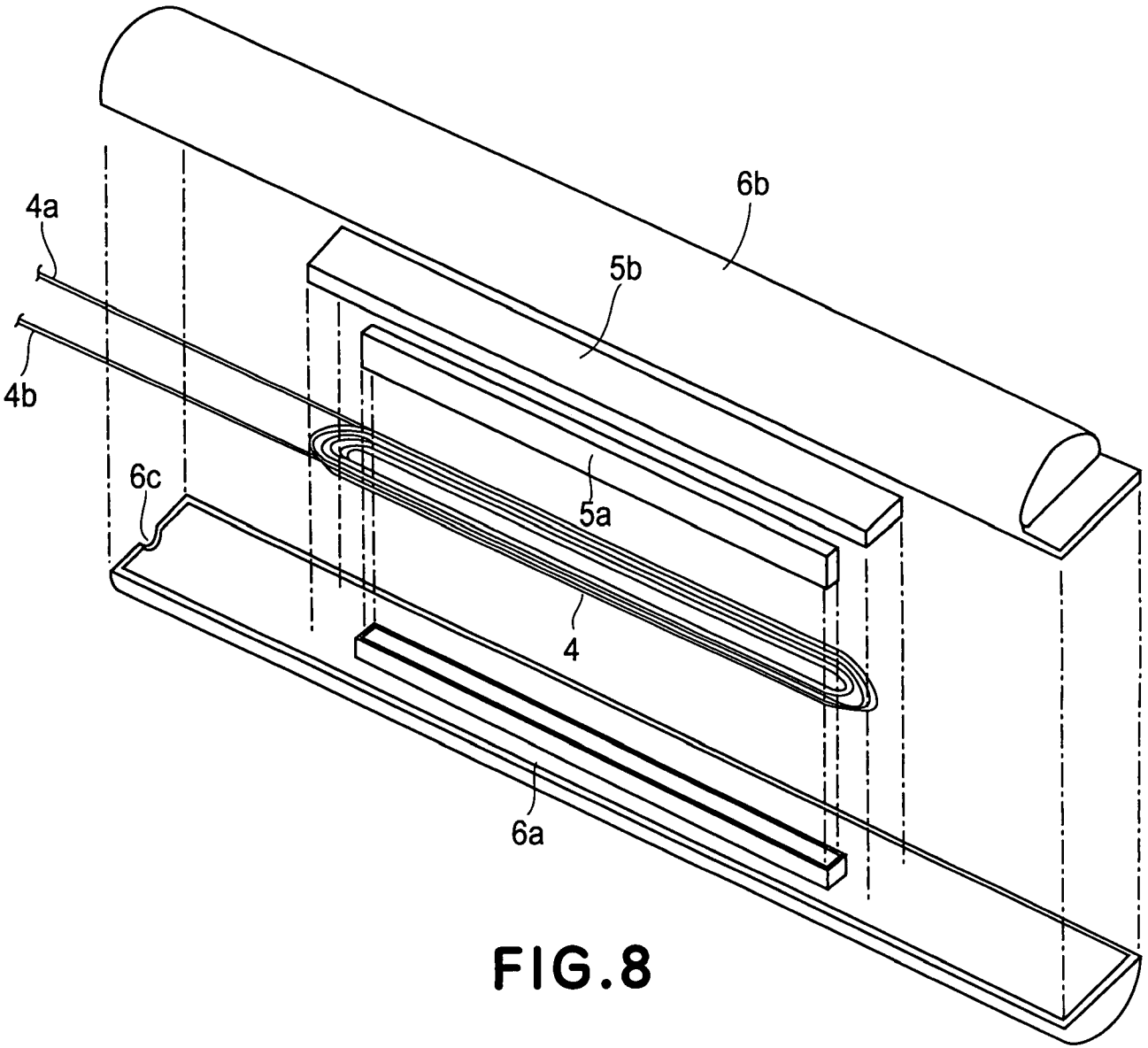
FIG. 8 is an exploded perspective view of a holder and components therein.

Designated by a referential numeral 3 is an exciting coil assembly as a magnetic flux generating means (heating means). This exciting coil assembly 3 is disposed in the hollow of the abovementioned cylindrical fixation roller 1. The exciting coil assembly 3 is made up of an exciting coil 4, magnetic cores 5*a* and 5*b*, and a holder 6. The magnetic cores 5*a* and 5*b* are integrally attached to each other, yielding a component with a T-shaped cross section, and are disposed in the hollow of the holder 6. The exciting coil assembly 3 is also provided with a magnetic flux adjusting member 7 (magnetic flux shielding member: shutter), which is rotatably disposed on the outward side of the holder 6, coaxially with the holder 6. The magnetic flux adjusting member 7 constitutes a magnetic flux adjusting means in combination with magnetic flux adjusting member moving means M2, 30 to 33 described later. FIG. 6 is an external perspective view of this exciting coil assembly 3 and the magnetic flux adjusting member moving means M2, 30, 31, 32 and 33. FIG. 7 is an enlarged perspective view of the exciting coil assembly 3 and a first shutter gear G2 attached to one end portion of the exciting coil assembly 3. FIG. 8 is an exploded perspective view of the holder 6 and components therein.

Hereinafter, the lengthwise (longitudinal) direction of the structural components or the portions thereof of the fixing apparatus means the direction perpendicular to the recording material conveyance direction a.

The holder 6 is roughly cylindrical in cross section, from one lengthwise end to the other. As the material therefor, a liquid crystal polymer (LCP), which is heat resistant and has mechanical strength.

Referring to FIG. 8, the holder 6 is made up of two (first and second) roughly semicylindrical portions 6*a* and 6*b*, which are attached to each other with adhesive, or are interlocked to each other by providing the two portions 6*a* and 6*b* with such a shape that makes it possible to interlock the two portions 6*a* and 6*b* with each other, to form the holder 6, which is roughly cylindrical, from one lengthwise end to the other. The coil 4 and cores 5*a* and 5*b* are disposed in the first semicylindrical portion 6*a*, and then, the second semicylindrical portion 6*b* is bonded to the first semicylindrical portion 6*a* in a manner of encasing the coil 4 and core 5*a* and 5*b*, completing the holder 6 which internally holds the coil 4 and core 5*a* and 5*b*. Designated by referential numerals 4*a* and 4*b* are lead wires, which are extended outward from the holder 6 through a hole 6*c* of the front end wall of the holder 6.

Also as shown in FIG. 8, the coil 4 has a roughly elliptical shape (shape of long and narrow boat), the major axis of which is parallel to the lengthwise direction of the fixation roller 1. It is disposed in the hollow of the first semicylindrical portion 6*a* of the holder 6 so that its external contour follows the internal surface of the fixation roller 1. The coil 4 must be capable of generating an alternating magnetic flux strong enough to generate a sufficient amount of heat for fixation. Therefore, the coil 4 must be small in electrical resistance, and high in inductance. As the wire for the coil 4, Litz wire is used, which is made by bundling roughly 80–160 strands of fine wires, the diameter of which is in the range of 0.1–0.3 mm. The Litz wire is wound 6–12 times around the first core 5*a*.

The core 5*a* constitutes a first core (equivalent to vertical portion of T-shape) around which the Litz wire is wound. The core 5*b* constitutes a second core (equivalent to horizontal portion of T-shape). The two cores 5*a* and 5*b* are attached to each other so that the resultant component will be T-shaped in cross section. As the material for the cores 5*a* and 5*b*, such a substance as ferrite that is high in permeability, and yet, is low in residual magnetic flux density, is preferable. However, the only requirement for the material for the cores 5*a* and 5*b* is that the material is capable of generating magnetic flux. In other words, what is required of the material for the cores 5*a* and 5*b* is not particularly restrictive. Further, the cores 5*a* and 5*b* are not required to be in a specific form, or be made of a specific material. Moreover, the first and second core 5*a* and 5*b* may be integrally formed in a single piece magnetic core, which is T-shaped in cross section.

Referring to FIGS. 6 and 7, the magnetic flux adjusting member 7 is shaped so that its cross section is arcuate, from one lengthwise end to the other. It has a pair of broader shutter portions 7*a* and 7*a* having the arcuate cross section, a pair of narrower shutter portions 7*b* and 7*b* which are disposed between the shutter portions 7*a* and 7*a* in a circumferential direction and have the arcuate cross section, and a connective portion 7*c* having also the arcuate cross section. The connective portion 7*c* is the center portion of the magnetic flux adjusting member 7, which connects the shutter portions 7*a* and 7*a* and 7*b* and 7*b*. As for the material for the magnetic flux adjusting member 7, such a nonferrous metallic substance as aluminum, copper, or the like is used, and among nonferrous metallic substances, those which are lower in electrical resistance are preferable. The magnetic flux adjusting member 7 is also provided with a pair of protrusions 7*d* and 7*d*, which protrude from the outward edges of the shutter portions 7*a* and 7*a*, one for one, in the lengthwise direction of the magnetic flux adjusting member 7. These protrusions 7*d* and 7*d* are engaged with the first and second shutter gears G2 and G3 rotatably fitted around the front and rear end portions of the holder 6. With the provision of the above described structural arrangement, the magnetic flux adjusting member 7 is held at its lengthwise ends by the first and second shutter gears G2 and G3, between the first and second shutter gears G2 and G3.

The fixing apparatus 100 is structured so that the holder 6 of the exciting coil assembly 3 is supported as shown in FIGS. 2 and 4. That is, one of the lengthwise end portions of the cylindrical holder 6 is extended outward beyond the front end of the fixation roller 1, through the front opening of the fixation roller 1, and is fitted in the hole 26*c* of the second portion 26*b* of the front supporting member 26 attached to the outward side of the front plate 21 of the fixing apparatus 100, being thereby supported by the front plate 21. The other lengthwise end portion of the holder 6 is extended outward beyond the rear end of the fixation roller 1, through the rear opening the fixation roller 1, and is fitted in the hole 27*c* of the second portion 27*b* of the rear supporting member 27 attached to the outward side of the rear plate 22 of the fixing apparatus 100, being thereby supported by the rear plate 22. More specifically, the rear end portion of the holder 6 is provided with a D-cut portion 6*d*, and the hole 27*c* of the rear supporting member 27 is D-shaped in cross section. Therefore, the holder 6 is nonrotationally supported by the front and rear plates 26 and 27 of the fixing apparatus 100. Also with the provision of the above described structural arrangement, the holder 6 is disposed in the hollow of the fixation roller 1 so that the two are coaxially disposed while providing a predetermined amount of gap between the peripheral surface of the holder 6 and internal surface of the fixation roller 1, and also, so that the holder 6 is nonrotationally held in a predetermined attitude, that is, at a predetermined angle in terms of its circumferential direction. The aforementioned lead wires 4*a* and 4*b* extending outward from the holder 6 through the hole 6*c*, with which the front end wall of the holder 6 is provided, are connected to an excitation circuit 51.

As described above, the magnetic flux adjusting member 7 is supported between the first and second shutter gears G2 and G3, by being supported at both of its lengthwise ends by the gears G2 and G3. That is, the protrusions 7*c* and 7*c* (FIGS. 6 and 7), which are the actual lengthwise end portions of the magnetic flux adjusting member 7, are supported by the first and second shutter gears G2 and G3 by being engaged with the first and second shutter gears G2 and G3, respectively, which are rotatably fitted around the front and rear end portions of the holder 6. In such an area that the first and second shutter gears G2 and G3 are not engaged with the protrusions 7*d* and 7*d* of the magnetic flux adjusting member 7, they are engaged with the holder 6. For this reason, the magnetic flux adjusting member 7 is disposed in planar contact with an outer surface of the holder 6 to be held by the gears G2 and G3 at their inner diameter portions (FIG. 4). Thus, as the first and second shutter gears G2 and G3 are rotated by the means M2, 30, 31, 32 and 33 for moving the magnetic flux adjusting member 7, the magnetic flux adjusting member 7 is rotated substantially about the axial line of the holder 6, through the gap between the outer surface of the magnetic flux adjusting member 7 and the inner surface of the fixation roller 1, in such a state that the inner surface of the magnetic flux adjusting member 7 contacts the outer surface of the holder 6 in a planar contact manner. Thus, the magnetic flux adjusting member 7 is rotationally moved while being supported by the inner diameter portions of the gears G2 and G3 in the planar contact state with the holder 6, so that local abrasion of the holder 6 is not caused to occur.

Referring to FIG. 6 which depicts the means M2, 30, 31, 32 and 33 for moving the magnetic flux adjusting member 7, a referential symbol M2 represents a second motor; 30: a shaft; 31: output gear; 32*a*, 32*b*: shaft drive gears; and a referential symbol 33*a* and 33*b* represent power transfer gears. The second motor M2 is a driving force source (power penetration means) for rotating the shaft 30, and is a stepping motor. The shaft 30, which is located outside the fixation roller 1, is rotatably supported in parallel to the fixation roller 1, by the front and rear plates 21 and 22 of the fixing apparatus 100, with a pair of bearings (unshown) placed between the shaft 30 and the plates 21 and 22. The shaft drive gears 32*a* and 32*b* are concentrically fixed to the shaft 30. The shaft drive gear 32*a* is engaged with the output gear 31. The power transfer gears 33*a* and 33*b* are multiplestage gears including a major diameter gar and a minor diameter gear. The power transfer gear 33*a* is fixedly attached to a pivot (not shown) which is rotatably supported by the front plate 21 via a bearing member (not shown) outside the fixation roller. The power transfer gear 33*b* is fixedly attached to a pivot (not shown) which is rotatably supported by the rear plate 22 via a bearing member (not shown) outside the fixation roller 1. The power transfer gears 33*a* and 33*b* are disposed so that their major diameter gears are engaged with the shaft drive gears 32*a* and 32*b*, respectively, and their minor diameter gears are engaged with the shaft gears G2 and G3, respectively. When the second motor M2 is rotationally driven, the rotational force is transmitted to the shutter gears G2 and G3 through the output gear 31, the shaft drive gears 32*a* and 32*b*, and the power transfer gears 33*a* and 33*b*. The shutter gear G2 is provided with first to third cut portions Gaa, Gab and Gac, and an amount of rotational drive thereof is controlled by ON and OFF signals detected when the first to third cut portions Gaa, Gab and Gac pass through a position detection sensor 34. Cut positions of the first to third cut portions Gaa, Gab and Gac correspond to an amount of rotational drive of the magnetic flux adjusting member 7 which effects magnetic flux adjustment with the shutter portions 7*a*, 7*a*, 7*b* and 7*b* by being rotationally driven appropriately depending on various paper (sheet) sizes, such as a small-sized sheet, a middle-sized sheet, etc. Thus, the first and second shutter gears G2 and G3 are rotationally moved, whereby the magnetic flux adjusting member 7 is caused to rotate about the axial line of the holder 6 in a manner to follow the peripheral surface of the holder 6 while slidably contacting the outer surface of the holder 6. As for the material for the gears, one of the various resinous substances may be selected according to the ambient temperature, and the amount of torque to which they are subjected.

Referring to FIG. 2, designated by a referential numeral 50 is a control circuit portion (CPU), which activates the first motor M1 at a predetermined control timing, through a driver 52, according to an image formation sequence. As the first motor M1 is activated, the rotational force is given to the driving gear G1 of the fixation roller 1, rotationally driving the fixation roller 1 in the clockwise direction indicated by an arrow in FIG. 3. The pressure roller 2 is rotated by the rotation of the fixation roller 1.

The control circuit portion 50 also activates the exciting circuit 51 at a predetermined timing, supplying thereby the coil 4 with alternating electric current. As a result, an alternating magnetic flux (alternating magnetic field) is generated, and therefore, heat is generated in the wall of the fixation roller 1 by electromagnetic induction, causing the fixation roller 1 to increase in temperature.

Figure 9:
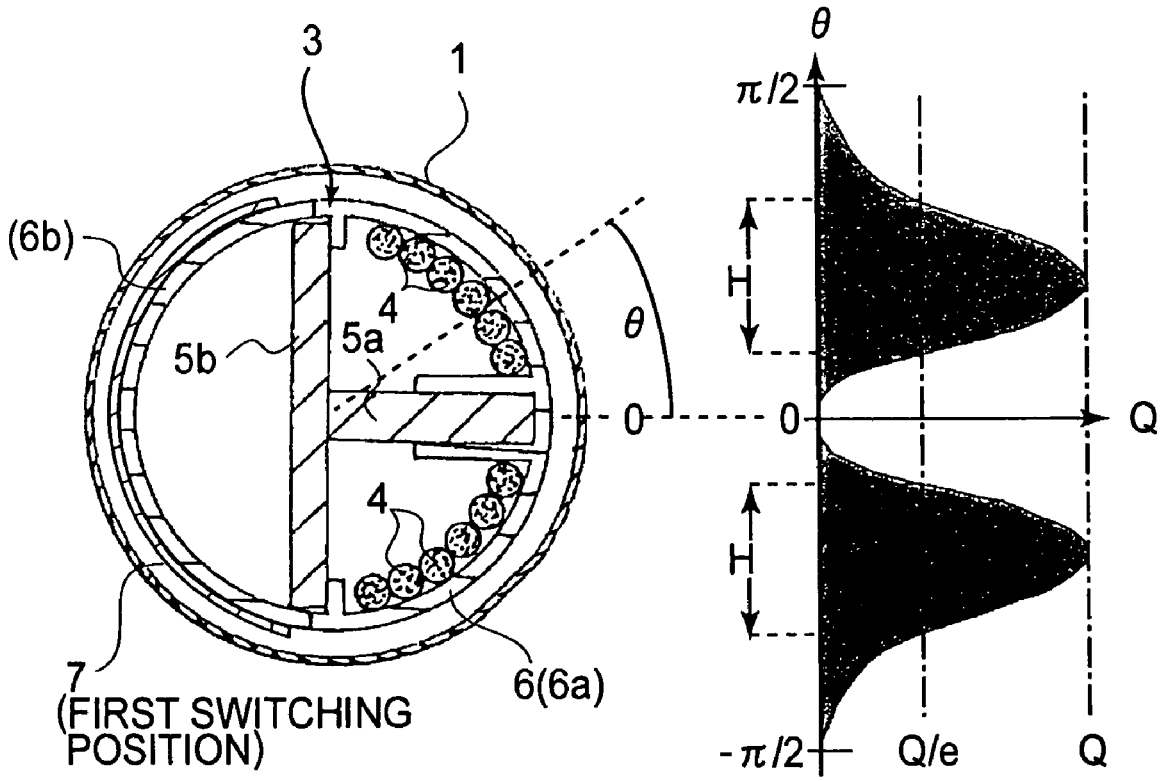
FIG. 9 is an explanatory view for illustrating a principal magnetic flux generation area and a corresponding distribution of an amount of heat generation at a fixing roller portion in a circumferential direction of the fixing roller portion.

FIG. 9 is the combination of a schematic cross-sectional view of the fixation roller 1 in the system such as the above described one, and a graph showing a distribution of amount of heat generation of the fixation roller 1 in the heated condition. It shows the areas to which the major portion of the magnetic flux generated by the magnetic flux generating means concentrates, and the corresponding heat distribution of the fixation roller 1, in terms of the circumferential direction of the fixation roller 1. As alternating electric current is flowed through the coil 4, the coil 4 generates an alternating magnetic flux. The fixation roller 1 is formed of a magnetic metal or a magnetic material. Within the wall of the fixation roller 1, induced current (eddy current) is induced in a manner to neutralize the magnetic field. This induced current generates heat (Joule heat) in the wall of the fixation roller 1, increasing thereby the fixation roller 1 in temperature.

In the case of the structure of the fixing apparatus in this embodiment, the area in which the magnetic flux is principally generated is on the outward side of the first semicylindrical portion 6*a* of the holder 6, in which the coil 4 and cores 5*a* and 5*b* are disposed. Thus, the portion of the fixation roller 1, which is in this magnetic flux generation area, is where heat is generated by the magnetic flux. The heat distribution of the fixation roller 1, in terms of the circumferential direction of the fixation roller 1, across the portion in the abovementioned magnetic flux generation area, has two areas H and H, in which most of the heat is generated, as shown in FIG. 9. In this embodiment, the holder 6 is nonrotationally held (positioned) at such an angle in terms of the circumferential direction of the holder 6 that the portion of the coil 4, which corresponds to one of the two areas H and H, faces the fixation nip portion N, and the portion of the coil 4, which corresponds to the other of the two areas H and H, faces the immediate adjacencies of the fixation nip portion N on the upstream side in terms of the rotational direction of the fixation roller 1.

When the magnetic flux adjusting member 7, which is in the gap between the outer surface of the magnetic flux adjusting member 7 and the inner surface of the fixation roller 1, is not required to adjust the magnetic flux, it is moved into, and kept in, the position shown in FIGS. 3 and 9, which is on the opposite side of the fixing apparatus from the aforementioned areas in which the magnetic flux is generated. This area is where an effective magnetic flux from the magnetic flux generating means does not substantially act on the fixation roller 1 or extremely low in density. This position shown in FIGS. 3 and 9 will be referred to as a "first position".

The temperature of the fixation roller 1 is detected by a central thermistor TH1 as a temperature detecting means, disposed at the roughly mid point of the fixation roller 1 in terms of the lengthwise direction thereof, in contact, or with no contact, with the fixation roller 1, and the detected temperature is inputted into the control circuit 50, which controls the temperature of the fixation roller 1 by controlling the electric power supplied from the exciting circuit 51 to the coil 4, so that the fixation roller temperature detected by the central thermistor TH1 and inputted into the control circuit 50 remains at a predetermined target temperature (fixation temperature). While the magnetic flux adjusting member 7 is kept in the first position shown in FIGS. 3 and 9, the fixation roller 1 is controlled in temperature so that the temperature of the fixation roller 1 is kept at the target level across the entirety of its effective range (heatable range) in terms of its lengthwise direction.

While the fixation roller temperature is kept at the predetermined fixation level after being raised thereto, a recording material P carrying an unfixed toner image t is introduced into the fixation nip portion N, and is conveyed through the fixation nip portion N while being kept pinched by the fixation roller 1 and pressure roller 2. As the recording material P is conveyed through the fixation nip N, the unfixed toner image t on the recording material P is fixed to the surface of the recording material P by the heat from the fixation roller 1 and the pressure at the fixation nip portion N.

Hereinafter, the term, a recording material width (sheet width or paper width) means the dimension of a recording material, in terms of the direction perpendicular to the recording material conveyance direction a, when the recording material P is completely flat. As described above, in this embodiment, the recording material P is conveyed through the fixing apparatus (image forming apparatus) so that the center of the recording material P in terms of its width direction coincides with the center of the fixing apparatus (fixation roller 1) in terms of the width direction of the recording material P (center line-based sheet passing standard). Referring to FIGS. 2 and 4, designated by a referential symbol ○ is the center line (hypothetical line), as the referential line, of the fixation roller 1 (recording material) in terms of its lengthwise direction, and designated by a referential symbol A is the width of the path of the largest recording material, in terms of width, usable with the image forming apparatus. Designated by a referential symbol B is the width of the path of a recording material which is smaller in size than the largest recording material. Hereinafter, a recording material smaller in width than the largest recording material will be referred to as a "middle recording material". Designated by a referential symbol C is the width of the path of a recording material which is smaller in size them the middle recording material. Hereinafter, a recording material having a width corresponding the recording material width C will be referred to as a "small recording material". Designated by a referential symbol B' are the areas between the edges of a large recording material and the edge of a middle recording material. In other words, each of the areas B' is the portion of the recording material passage, which does not come into contact with a middle recording material when the middle recording material is conveyed through the fixing apparatus. Since a recording material is conveyed through the fixing apparatus so that the center of the recording material in terms of its width direction coincides with the center of the fixation roller 1 in terms of its lengthwise direction, there will be two areas B', one on the left side of the path B of the middle recording material, and the other on the right side of the path B of the middle recording material. The width of the areas B' is changed by the width of the middle recording material being conveyed through the fixing apparatus.

Designated by a referential symbol C' are the areas between the edges of a middle recording material and the edge of a small recording material. In other words, each of the areas C' is the portion of the recording material passage, which does not come into contact with a small recording material when the small recording material is conveyed through the fixing apparatus. Since a recording material is conveyed through the fixing apparatus so that the center of the recording material in terms of its width direction coincides with the center of the fixation roller 1 in terms of its lengthwise direction, there will be two areas C', one on the left side of the path B of the small recording material, and the other on the right side of the path B of the small recording material. The width of the areas B' is changed by the width of the small recording material being conveyed through the fixing apparatus.

The abovementioned central thermistor TH1 used for controlling the temperature of the fixation roller 1 is disposed within the path C of the small recording material so that it will be within the path of a recording medium regardless of recording material width.

Designated by a referential symbol TH2 is a peripheral thermistor as a temperature detecting means disposed within one of the areas B' and C', that is, the areas out-of-path (non-sheet-passing areas) of a recording material, in terms of the lengthwise direction of the fixation roller 1, in contact, or with no contact, with the fixation roller 1, in order to detect the increase in the temperature of the fixation roller 1, across the portions corresponding to the out-of-path areas B' and C'. The temperature data obtained by this peripheral thermistor TH2 are also inputted into the control circuit portion 50.

When multiple small recording materials are consecutively conveyed through the fixing apparatus 100, the portions of the fixation roller 1 corresponding in position to the out-of-path areas C' increases in temperature, and this increase in temperature is detected by the peripheral thermistor TH2, and the detected increase in temperature is inputted from the thermistor TH2 to the control circuit portion 50. When the temperature level of the out-of-path area C' inputted into the control circuit portion 50 by the peripheral thermistor TH2 exceeds the predetermined permissible range, the control circuit portion 50 rotationally moves the magnetic flux adjusting member 7 from the first position shown in FIGS. 3 and 9 into the second position shown in FIG. 10 by activating the second motor M2 through the driver 53.

The second position for the magnetic flux adjusting member 7 is such a position that when the magnetic flux adjusting member 7 is in this position, the arcuate shutter portions 7*a* and 7*a*, that is, the virtual end portions of the magnetic flux adjusting member 7 in its lengthwise direction, which are wider, in terms of the circumferential direction of the fixation roller 1, than the connective portion 7*c*, that is, the center portion of the magnetic flux adjusting member 7, are in the following positions. That is, the arcuate shutter portions 7*a* and 7*a* of the magnetic flux adjusting member 7 which is in the gap between the outer surface of the magnetic flux adjusting member 7 and the inner surface of the fixation roller 1, are placed in the portions of the above described gap, one for one, which correspond in position to the out-of-path areas C' in terms of the lengthwise direction of the fixation roller 1, and also, to the area in which the magnetic flux is generated, in terms of the circumferential direction of the fixation roller 1.

With the magnetic flux adjusting member 7 placed in the second position, the magnetic flux from the magnetic flux generating means is reduced in the effective amount by which it acts on the portion of the fixation roller 1 which corresponds in position to the out-of-path areas C' and C'. Therefore, the portions of the fixation roller 1 corresponding to the out-of-path areas C' are minimized in the amount by which heat is generated therein. Therefore, the problem that the portions of the fixation roller 1 corresponding to the out-of-path areas C' increase in temperature is prevented.

When multiple middle recording materials are consecutively conveyed through the fixing apparatus 100, the portions of the fixation roller 1 corresponding in position to the out-of-path areas B' increases in temperature, and this increase in temperature is detected by the peripheral thermistor TH2, and the detected increase in temperature is inputted from the thermistor TH2 to the control circuit portion 50. When the temperature level of the out-of-path area B' inputted into the control circuit portion 50 by the peripheral thermistor TH2 exceeds the predetermined permissible range, the control circuit portion 50 rotationally moves the magnetic flux adjusting member 7 from the first position shown in FIGS. 3 and 9 into the third position shown in FIG. 11 by activating the second motor M2 through the driver 53.

The second position for the magnetic flux adjusting member 7 is such a position that when the magnetic flux adjusting member 7 is in this position, the arcuate shutter portions 7*b* and 7*b*, that is, the virtual end portions of the magnetic flux adjusting member 7 in its lengthwise direction, which are wider, in terms of the circumferential direction of the fixation roller 1, than the connective portion 7*c*, that is, the center portion of the magnetic flux adjusting member 7, are in the following positions. That is, the arcuate shutter portions 7*b* and 7*b* of the magnetic flux adjusting member 7 which is in the gap between the outer surface of the magnetic flux adjusting member 7 and the inner surface of the fixation roller 1, are placed in the portions of the above described gap, one for one, which correspond in position to the out-of-path areas B' in terms of the lengthwise direction of the fixation roller 1, and also, to the area in which the magnetic flux is generated, in terms of the circumferential direction of the fixation roller 1.

With the magnetic flux adjusting member 7 placed in the third position, the magnetic flux from the magnetic flux generating means is reduced in the effective amount by which it acts on the portion of the fixation roller 1 which corresponds in position to the out-of-path areas B' and B'. Therefore, the portions of the fixation roller 1 corresponding to the out-of-path areas B' are minimized in the amount by which heat is generated therein. Therefore, the problem that the portions of the fixation roller 1 corresponding to the out-of-path areas B' increase in temperature is prevented.

Figure 10:
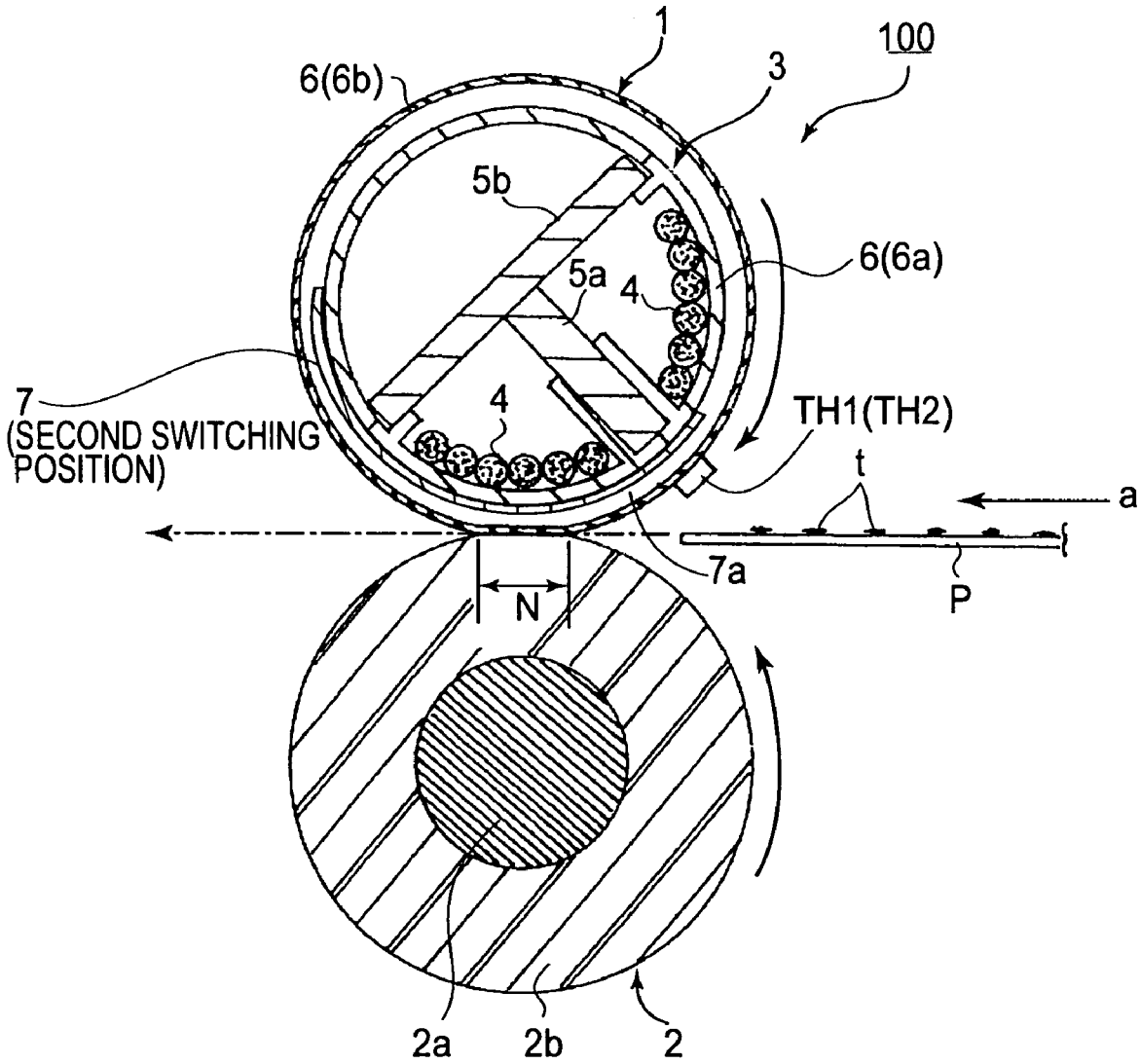
FIG. 10 is an enlarged cross-sectional view of the principal portion of the fixing apparatus in a state that the magnetic flux adjusting member is rotationally moved to a second switching position.
Figure 11:
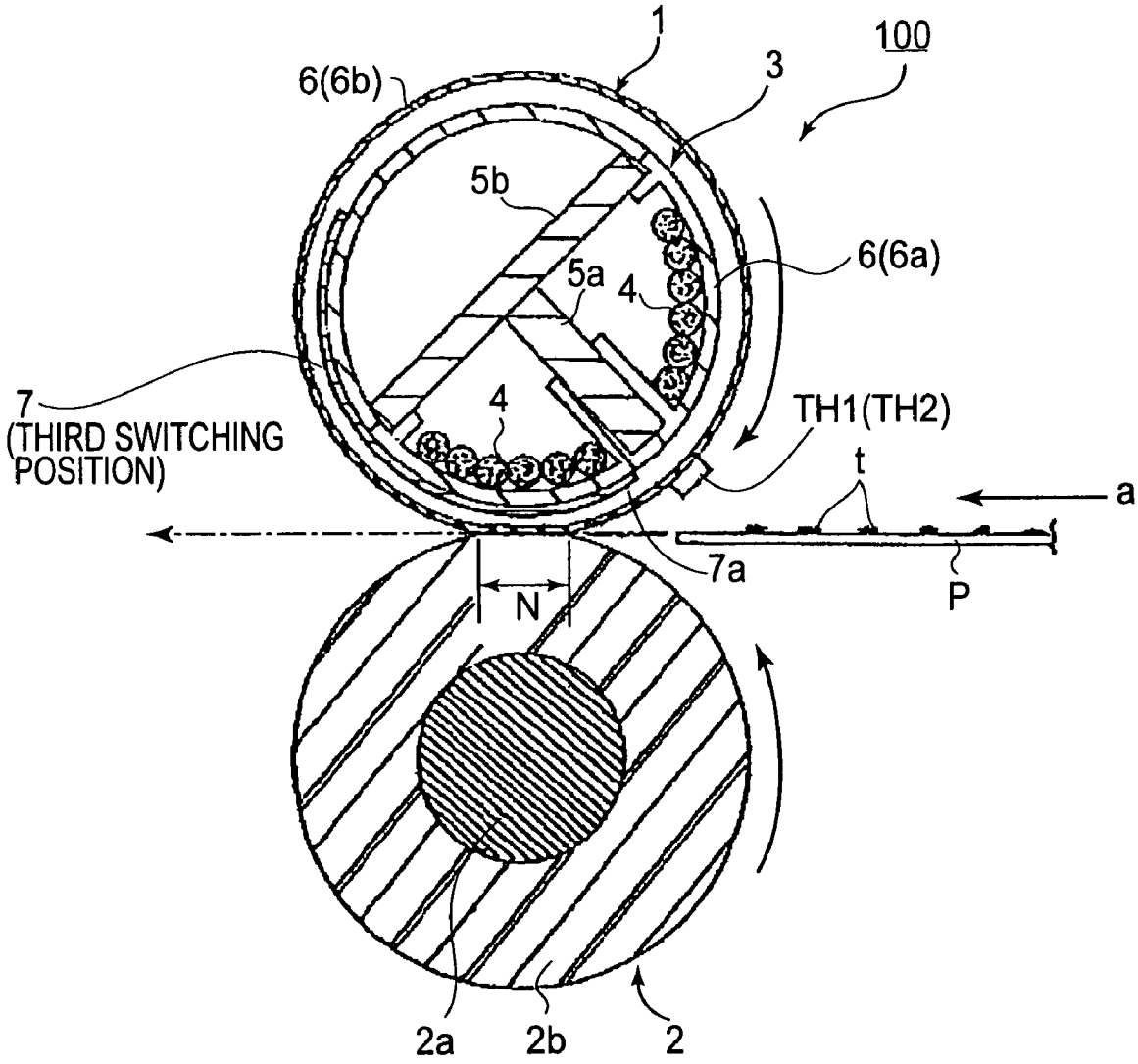
FIG. 11 is an enlarged cross-sectional view of the principal portion of the fixing apparatus in a state that the magnetic flux adjusting member is rotationally moved to a third switching position.

The shutter portions 7*a* and 7*a* and 7*b* and 7*b*, which correspond in position to the out-of-path areas C' and C' and B' and B', extend from one end of the magnetic flux generation area, in terms of the circumferential direction of the fixation roller 1 (holder 6), to the other, or a part of the way to the other. FIGS. 10 and 11 show the structural arrangement in which the shutter portions 7*a* and 7*a* and 7*b* and 7*b* extend from one end of the magnetic flux generation area halfway to the other.

As the magnetic flux adjusting member 7 is rotationally moved into the second position or the third position, the portions of the fixation roller 1 corresponding to the out-of-path areas C' and B' gradually reduce in temperature. When the temperature level of these portions inputted into the control circuit portion 50 by the peripheral thermistor TH2 falls below the predetermined permissible level i.e., when an excessively decreased temperature in the out-of-path areas is detected, the control circuit portion 50 rotationally moves the magnetic flux adjusting member 7 into the first position to prevent these portions of the fixation roller 1 from becoming too low in temperature.

Further, when an image forming operation which uses recording material of a small size is switched to an image forming operation which uses recording material of a large size after the magnetic flux adjusting member 7 is rotationally moved into the second position during the image forming apparatus using the recording materials of the small size, the control circuit portion 50 rotationally moves the magnetic flux adjusting member 7 back into the first position.

Further, when an image forming operation which uses recording material of a middle size is switched to an image forming operation which uses recording material of a large size after the magnetic flux adjusting member 7 is rotationally moved into the third position during the image forming apparatus using the recording materials of the middle size, the control circuit portion 50 rotationally moves the magnetic flux adjusting member 7 back into the first position.

Basically, the magnetic flux adjusting member 7 is arcuate in cross section from one lengthwise end to the other in terms of the lengthwise direction of the fixation roller 1 as described above. When the recording material of the small size or the middle size is conveyed through the fixing apparatus, the magnetic flux adjusting member 7 is rotated so that the shutter portions 7*a* and 7*a* or the 7*b* and 7*b* corresponding to the out-of-path areas are moved into the areas where the magnetic flux is generated, in order to prevent the fixation roller 1 from increasing in temperature at both end portions thereof. Further, the magnetic flux adjusting member (shutter portions) is moved into a central portion of the magnetic flux generation area corresponding to the sheet passing portion, whereby a heat generation distribution between the sheet passing portion and the out-of-path portion in the lengthwise direction of the fixation roller to suppress temperature rise of the fixation roller at end portions.

As described above, the magnetic flux adjusting member 7 is operated while sliding on the surface of the holder 6, but contamination, slight flaw, and the like are caused to occur during continuous use at the sliding surface (inner surface of the magnetic flux adjusting member and outer surface of the holder). These contamination and flaw are caused to occur in a streak form in the rotational movement direction of the magnetic flux adjusting member 7, so that such a problem that the rotation of the magnetic flux adjusting member 7 is slow is not caused to occur unless the relative position between the magnetic flux adjusting member 7 and the holder 6 in the lengthwise direction is deviated. However, the magnetic flux adjusting member 7 and the holder 6 are increased in temperature when the fixing apparatus is successively used, so that a change in relative thrust length is caused to occur due to a difference in coefficient of line expansion between the magnetic flux adjusting member 7 and the holder 6 to result in a positional deviation of the magnetic flux adjusting member 7 and the holder 6 in the lengthwise direction.

With respect to some materials for the magnetic flux adjusting member 7 and the holder 6, study on smooth rotational sliding of the magnetic flux adjusting member 7 in terms of contamination and flaw in successive use was made.

Coefficients of line expansion of respective materials for the magnetic flux adjusting member 7 (magnetic flux shielding member) and the holder 6 in the lengthwise direction of the fixation roller are shown in Table 1.

TABLE 1

| Member | Material | Coefficient of line expansion |
|---|---|---|
| $\alpha^{*1}$ | Copper | $1.7 \times 10^{-5}$ |
| $\alpha$ | Aluminum | $2.5 \times 10^{-5}$ |
| $\beta^{*2}$ | PEEK | $4.7 \times 10^{-5}$ |
| $\beta$ | LCP | $0.9 \times 10^{-5}$ |
| $\beta$ | PPS | $2.5 \times 10^{-5}$ |
| $\beta$ | PBT | $2.0 \times 10^{-5}$ |

*1 line expansion coefficient $\alpha$ of magnetic flux adjusting member 7
*2 line expansion coefficient $\beta$ of holder 6

A maximum length d (mm) of an amount of positional deviation in a lengthwise direction of a sliding portion between the magnetic flux adjusting member 7 and the holder 6 is represented by the following equation:

$$d=(\alpha-\beta)\times T\times L,$$

wherein $\alpha$ represents a coefficient of linear expansion of the magnetic flux adjusting member; $\beta$ represents a coefficient of linear expansion of the holder; T represents an increased temperature (° C.) of the holder from room temperature to a temperature during continuous use of the heating apparatus; and L represents a length (mm) of a sliding portion between the magnetic flux adjusting member and the holder in the lengthwise direction.

The length L is, as shown in FIG. 4, a contact length between the magnetic flux adjusting member 7 and the holder 6 in the lengthwise direction of the fixation roller.

Further, the room temperature means a temperature of an environment in which the image forming apparatus is placed.

In the case of a fixing apparatus of this embodiment, during continuous use of the fixing apparatus, a temperature of the holder is about 215° C. in an environment of a room temperature of 25° C., so that an increased temperature T from the room temperature of the holder is 190° C. Further, in this embodiment, the length L of the sliding portion in the lengthwise direction is 412 mm.

Results of the maximum length d (mm) of lengthwise positional deviation and study on the smooth rotational sliding ("Smoothness") with respect to some combinations of materials for the magnetic flux adjusting member ("Adjusting member") and the holder ("Holder") are shown in Table 2.

TABLE 2

| Adjusting member | Holder | d (mm) | Smoothness* |
|---|---|---|---|
| Copper | PEEK | −2.3484 | x |
| Copper | LCP | 0.62624 | ○ |
| Copper | PPS | −0.62624 | ○ |
| Copper | PBT | −0.23484 | ○ |
| Aluminum | PEEK | −1.72216 | x |
| Aluminum | LCP | 1.25248 | x |
| Aluminum | PPS | 0 | ○ |
| Aluminum | PBT | 0.3914 | ○ |

*"○" means that smooth rotational sliding is ensured by the combination of materials.
"x" means that slow rotational sliding or the like is caused to occur.

As shown in Table 2, it is possible to maintain a smooth rotational movement operation even when the contamination and the flaw are caused to occur at the sliding surface (interface) between the magnetic flux adjusting member 7 and the holder 6 in the case where an absolute value of the above described maximum length d (mm) is not more than 0.7 (mm), i.e., the following relationship is satisfied:

$$0.7 \leqq (\alpha-\beta)\times T\times L \leqq 0.7.$$

More specifically, the materials capable of satisfying the above relationship, i.e., the maximum length d (mm) of not more than 0.7 (mm) are LCP, PPS and PBT for the holder 6 when the magnetic flux adjusting member 7 is copper and PPS and PBT for the holder 6 when the magnetic flux adjusting member 7 is aluminum.

(3) Miscellanies

Figure 12:
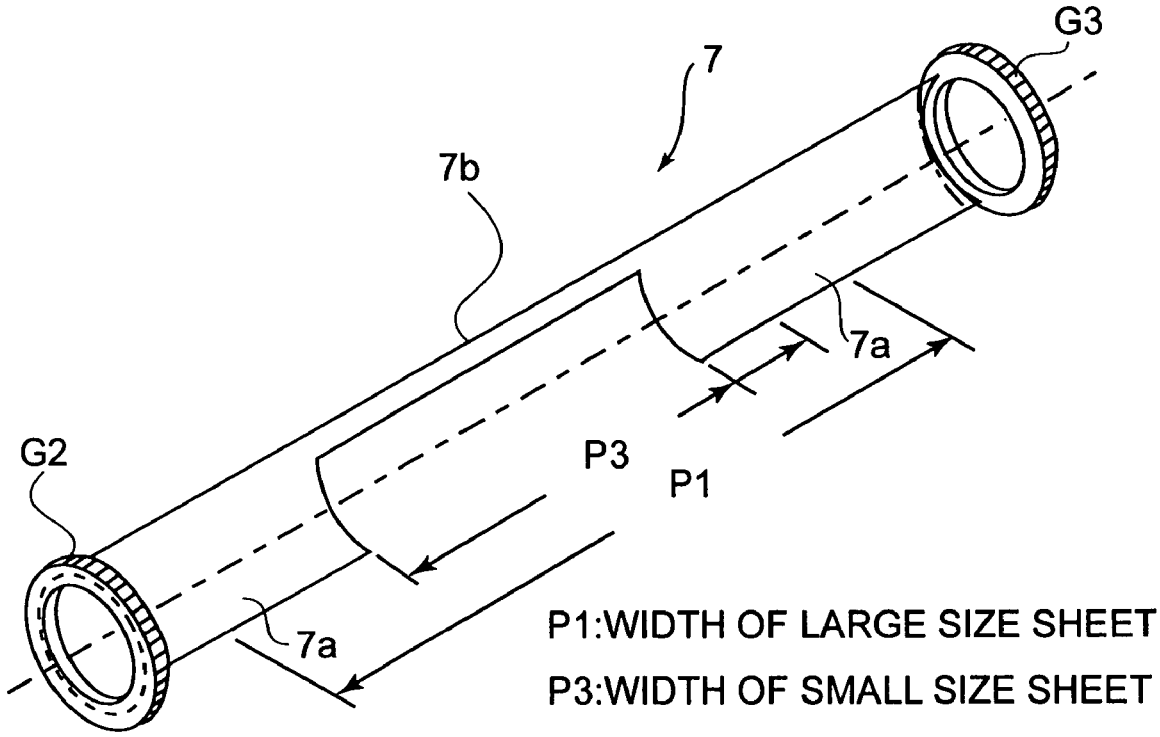
FIG. 12 is a schematic perspective view of the magnetic flux adjusting member capable of accommodating to sheet widths of two types of recording materials including large- and small-sized sheets.

1) The fixing apparatus in this embodiment is constituted to accommodate three kinds of recording materials different in size: recording material of a large size, recording material of a middle size, and recording medium of a small size. Thus, its magnetic flux adjusting member 7 is moved into the first position, second position, or third position according to the three recording material sizes. However, this embodiment is not intended to limit the scope of the present invention. Obviously, a fixing apparatus may be constituted so that its magnetic flux adjusting member is moved to one of two positions according to two recording material sizes (widths). FIG. 12 is a schematic perspective view of a magnetic flux adjusting member 7 constituted to accommodate two kinds of recording materials different in width.

Figure 13:
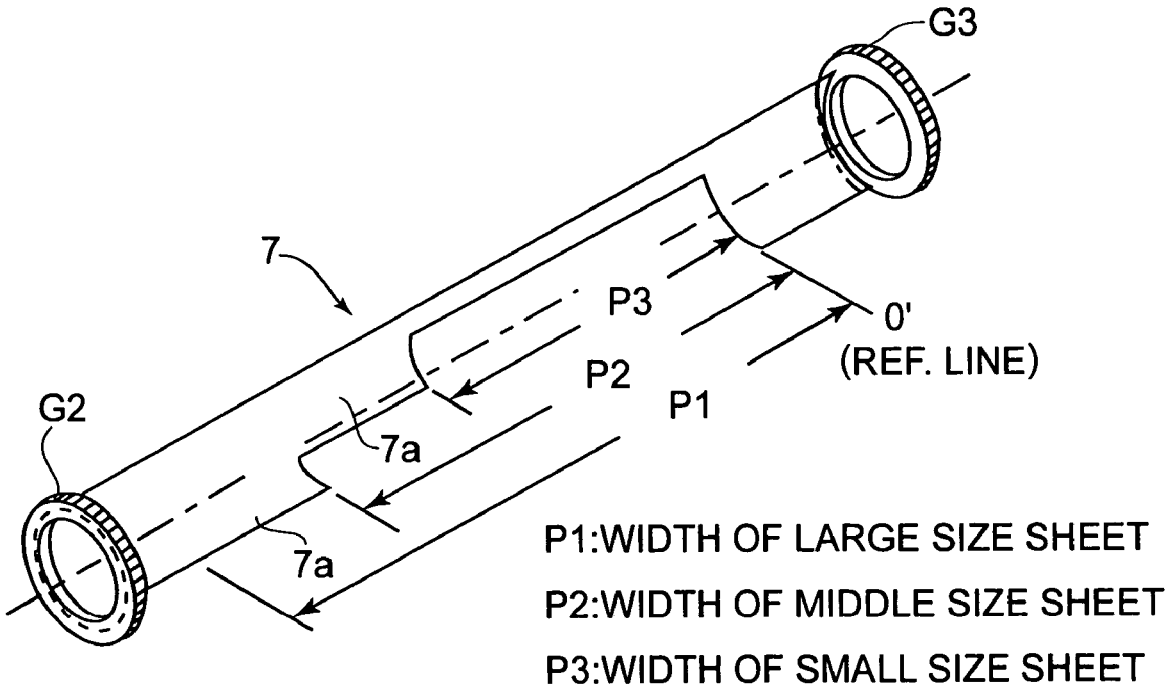
FIG. 13 is a schematic perspective view of an embodiment of the magnetic flux adjusting member in the case where the fixing apparatus employs a sheet passing standard on the basis of a right-hand reference line.
Figure 14:
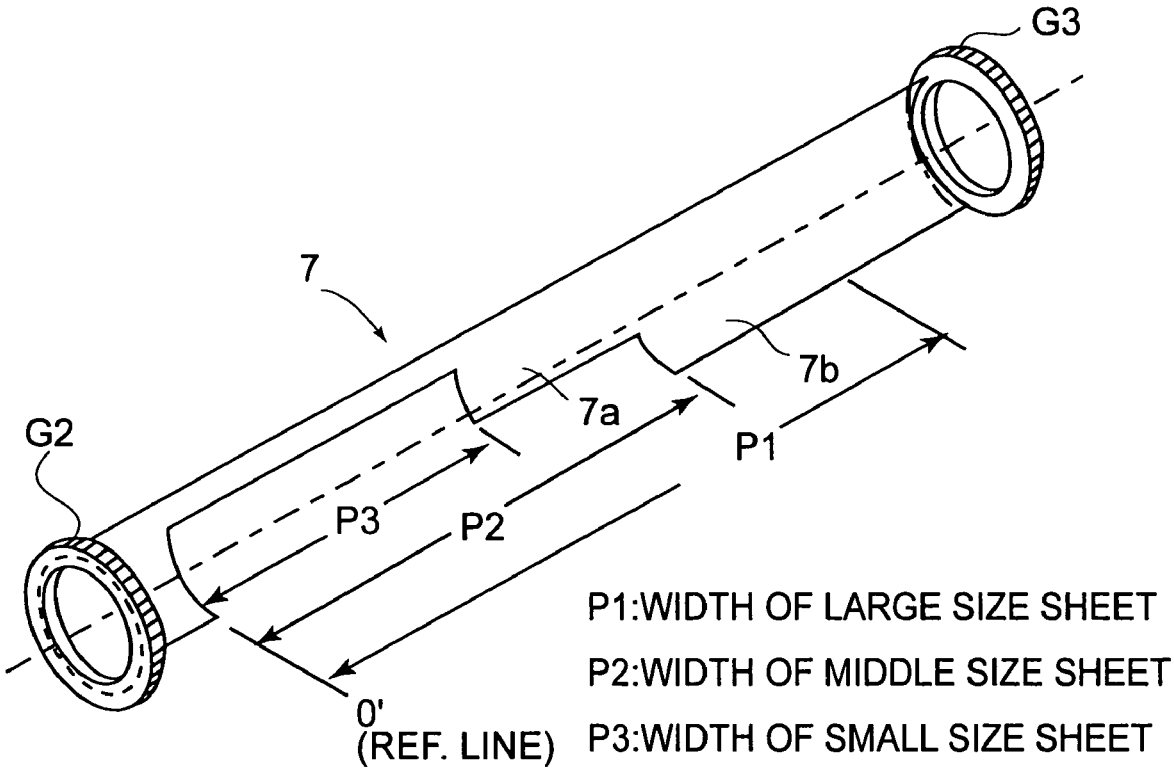
FIG. 14 is a schematic perspective view of an embodiment of the magnetic flux adjusting member in the case where the fixing apparatus employs a sheet passing standard on the basis of a left-hand reference line.

2) The fixing apparatus (image forming apparatus) is structured to convey a recording medium in such a manner that the center line of the recording material, in terms of the direction perpendicular to the recording material conveyance direction, coincides with the lengthwise center of the fixation roller (center line-based sheet passing standard). However, the present invention is effectively applicable also to a fixing apparatus (image forming apparatus) structured to convey a recording material in such a manner that one of the lateral edges of a recording material is kept aligned with a referential line (member) with which the apparatus is provided (one edge line-based sheet passing standard). FIGS. 13 and 14 show the examples of the shape of the magnetic flux adjusting member for such an apparatus that it employs the one edge line-based sheet passing standard. The edge lines, in the two drawings, designated by a referential symbol ○' are the referential lines for the one edge line-based sheet passing standard.

3) An image heating apparatus of an electromagnetic induction heating-type according to the present invention is not limited to the image heating (fixing) apparatus in this embodiment. That is, the present invention is also applicable to image heating apparatuses such as an image heating apparatus for temporarily fixing an unfixed image to a recording material, and a surface modifying apparatus for reheating a recording material carrying a fixed image to modify the fixed image in surface properties such as glossiness. Moreover, the present invention is effectively applicable to a heating apparatus for heating a sheet-like material to be heated, for example, a thermal pressing apparatus for removing creases from the sheet-like material to be heated, a thermal laminating apparatus, a thermal drying apparatus for evaporating water content from a member, such as paper, to be heated.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 308906/2004 filed Oct. 22, 2004, which is hereby incorporated by reference.

What is claimed is:

1. A heating apparatus for heating a material to be heated by heat generated by induction heat generation member, comprising:

magnet flux generating means;

a holder for holding and fixing said magnetic flux generating means and having a coefficient β;

an induction heating member which generates heat by electromagnetic induction heating by an action of magnetic flux generated by said magnetic flux generating means; and magnetic flux adjusting means for adjusting an area in which magnetic flux acts on said magnetic flux generating means in a longitudinal direction, of said induction heat generation member, perpendicular to a conveyance direction of a material to be heated; said magnetic flux adjusting means comprising a magnetic flux adjusting member, having a coefficient α, capable of coming into surface contact with said holder in the longitudinal direction of said induction heat generation member and moving means for moving said magnetic flux adjusting member by sliding said magnetic flux adjusting member on the surface of said holder;

control means for controlling a length L (mm) of the sliding portion between said magnetic flux adjusting member and said holder in the longitudinal direction, according to the following relationship:

$$-0.7 \leqq (\alpha-\beta)\times T\times L \leqq 0.7,$$

wherein $\alpha$ represents a coefficient of linear expansion of said magnetic flux adjusting member; $\beta$ represents a coefficient of linear expansion of said holder; T represents an increased temperature (° C.) of said holder from room temperature to a temperature during continuous use of said heating apparatus.

* * * * *

UNITED STATES PATENT AND TRADEMARK OFFICE

CERTIFICATE OF CORRECTION

PATENT NO. : 7,199,339 B2
APPLICATION NO. : 11/254708
DATED : April 3, 2007
INVENTOR(S) : Jiro Shirakata et al.

It is certified that error appears in the above-identified patent and that said Letters Patent is hereby corrected as shown below:

ON THE COVER PAGE

At Item (56), U.S. Patent Documents,

"2006/0086731 A1 4/2006 Shiraka et al. .....219/645" should read --2006/0086731 A1 4/2006 Shirakata et al. .....219/645--.

At Item (57), Abstract, line 2, "by induction" should read --by an induction--.

COLUMN 1

Line 12, "electrophoto-graphic" should read --electrophotographic--.
Line 16, "heatings" should read --heats--.
Line 23, "heating-fixing" should read --heat-fixing--.
Line 63, "slided" should read --slid--.

COLUMN 5

Line 21, "It is a" should read --It is--.

COLUMN 6

Line 5, "25*b*attached" should read --25*b* attached--.
Line 6, "slide" should read --slid--.
Line 49, "material therefor, a" should read --material, therefore, is a--.

COLUMN 7

Line 29, "core" should read --cores--.

COLUMN 9

Line 5, "roller." should read --roller 1.--.

COLUMN 10

Line 33, "or extremely" should read --or is extremely--.

COLUMN 11

Line 21, "them" should read --than--.

UNITED STATES PATENT AND TRADEMARK OFFICE

CERTIFICATE OF CORRECTION

PATENT NO. : 7,199,339 B2
APPLICATION NO. : 11/254708
DATED : April 3, 2007
INVENTOR(S) : Jiro Shirakata et al.

It is certified that error appears in the above-identified patent and that said Letters Patent is hereby corrected as shown below:

COLUMN 12
Line 8, “increases” should read --increase--.
Line 51, “increases” should read --increase--.

COLUMN 14
Line 7, “distribution between” should read --distribution is between--.

COLUMN 16
Line 41, “by induction” should read --by an induction--.
Line 43, “magnet” should read --magnetic--.
Line 49, “and” should be deleted.
Line 61, “holder;” should read --holder; and--.

Signed and Sealed this

Twenty Second Day of April, 2008

JON W. DUDAS
*Director of the United States Patent and Trademark Office*